US006386956B1

(12) United States Patent
Sato et al.

(10) Patent No.: US 6,386,956 B1
(45) Date of Patent: May 14, 2002

(54) FLATTENING POLISHING DEVICE AND FLATTENING POLISHING METHOD

(75) Inventors: Shuzo Sato; Takuo Ihira, both of Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/431,062

(22) Filed: Nov. 1, 1999

(30) Foreign Application Priority Data

Nov. 5, 1998 (JP) ..... 10-314685

(51) Int. Cl.[7] ..... B24B 7/22
(52) U.S. Cl. ..... 451/57; 451/65
(58) Field of Search ..... 451/41, 37, 461, 451/259, 65, 548, 446, 56

(56) References Cited

U.S. PATENT DOCUMENTS 2,309,016 A * 1/1943 Ryan ..... 451/548
2,629,975 A * 3/1953 Desenberg ..... 451/159
2,646,655 A * 7/1953 Laverdisse ..... 451/41
2,673,425 A * 3/1954 Karnell ..... 451/548
2,749,684 A * 6/1956 Schuhmann ..... 451/548
2,819,569 A * 1/1958 Angenieux ..... 451/41
3,841,031 A * 10/1974 Walsh ..... 451/41
5,643,837 A 7/1997 Hayashi
5,688,720 A 11/1997 Hayashi

FOREIGN PATENT DOCUMENTS

EP 0857541 8/1998

* cited by examiner

*Primary Examiner*—Robert A. Rose
(74) *Attorney, Agent, or Firm*—Ronald P. Kananen, Esq.; Rader, Fishman & Grauer, PLLC

(57) ABSTRACT

A flattening polishing device and method of the present invention is provided with a first polishing buff and a second polishing wheel disposed coaxially, a moving mechanism for moving the respective polishing buff and wheel relative to each other in an axial direction and a rotary drive for rotating the respective polishing buff and wheel around a shaft, thus enabling flattening and polishing with high accuracy and no defects.

11 Claims, 13 Drawing Sheets

| | 0.25μm | 0.30μm | 0.60μm | 0.90μm | 2.00μm |
|---|---|---|---|---|---|
| | 290 | 280 | 280 | 260 | 240 |
| | 320 | 320 | 325 | 320 | 315 |
| EROSION AMOUNT | 30 | 40 | 45 | 60 | 75 |
| LINE AND SPACE | 0.48 | 0.45 | 0.30 | 0.24 | 0.1 |

UNIT : nm

FLATTENING POLISHING DEVICE AND FLATTENING POLISHING METHOD

BACKGROUND OF THE INVENTION

1. Field of the Invention

This invention relates to flattening polishing devices and flattening polishing methods for flatly polishing plated films or insulating films formed on, for example, wafer surfaces.

2. Description of the Related Art

FIGS. 10A to 10F show sectional side elevation views illustrating manufacturing processes for a metal interconnection type board.

An interconnection pattern 2 composed of copper (Cu) is formed on a surface of a wafer 1 composed of silicon so as to coat the surface of the wafer 1 including the interconnection pattern 2 with an insulating film 3 composed of silicon dioxide ($SiO_2$) (FIG. 10A).

Further, conducting holes 4 for a laminated interconnection pattern are etched to be formed in the insulating film 3 (FIG. 10B), so as to coat the surface of the insulating film 3 including inner surfaces of the conducting holes 4 with a barrier film 5 composed of tantalum (Ta) or titanium (Ti) or the like (FIG. 10C), and seed films 6 composed of copper (Cu) are formed by sputtering(FIG. 10D). Further, a film 7 for the laminated interconnection pattern composed of copper (Cu) is plated in a comparatively thick condition and is formed in such a manner that inner portions of the conducting holes 4 are completely blocked (FIG. 10E). Thereafter, unnecessary films 7 for the laminated interconnection pattern on the barrier film 5 are machined to be polished so as to remove them and a laminated interconnection pattern 8 is formed so as to have a final metal interconnection type board 9 (FIG. 10F).

FIG. 12 shows a sectional side elevation view illustrating a manufacturing process for an element separation type board.

Elements 12 are formed on a surface of a wafer 11 composed, for example, of silicon so as to coat the surface of the wafer 11 containing the elements 12 with stopper films 13 composed of silicon nitride (SiN). Further, element separating trench holes 14 are etched to be formed from the stopper films 13 over to the wafer 11 so as to coat the holes, in a relatively thick condition, with an insulating film 15 composed of silicon dioxide ($SiO_2$) in such a manner that an inner portion of the trench holes 14 are completely blocked (FIG. 12A). Thereafter, unnecessary insulating films 15 on the stopper films 13 are machined to be polished so as to remove them and trenches 16 are formed so as to have the final element separation type board 17 (FIG. 12B).

In a polishing process, when manufacturing the above respective boards 9 and 17, the flattening polishing device is used.

FIG. 14 shows a perspective view illustrating an outline of a related flattening polishing device.

This flattening polishing device 20 is provided with a rotatable surface plate 22 in a shape of a disk on a top face of which a polishing cloth 21 is stuck, a rotatable and vertically (along the Z axis) movable mounting plate 23 in a shape of a disk for holding wafers 1 and 11 by bottom faces thereof and a nozzle 24 for supplying a polishing liquid P on the polishing cloth 21.

In such constitution, first, the surfaces of the wafers 1 and 11 on which the films 7 and 15 are formed are faced downward, a reverse face of the wafer 1 is bonded or is vacuum-adsorbed to the bottom face of the mounting plate 23. Next, while the surface plate 22 and the mounting plate 23 are rotated, the polishing solution P is supplied on the polishing cloth 21 from the nozzle 24. Further, the mounting plate 23 is lowered, the surfaces of the wafers 1 and 11 are forcedly pressed on the polishing cloth 21 so as to polish the films 7 and 15 formed on the surfaces of the wafers 1 and 11.

In an initial stage of the polishing process on the occasion of respectively manufacturing the above described boards 9 and 17, only a kind of film that is respectively the film 7 for the laminated interconnection pattern or the insulating film 15 may well be polished. However, in the final stage, since it is respectively necessary to expose the barrier film 5 or the stopper film 13, two kinds of films should concurrently be polished, that is, not only the film 7 for the laminated interconnection pattern or the insulating film 15, but also the barrier film 5 or the stopper film 13.

When the films of different kinds, in other words, the films of different hardness are polished using the related flattening polishing device 20, there are such cases where defects such as dishing, erosion (thinning) recess, scratch, chemical damage, overpolishing, and underpolishing are formed.

FIG. 11 shows a sectional side elevation view illustrating defects in the metal interconnection type board 9 and FIG. 13 shows a sectional side elevation view illustrating defects in the element separation type board 17.

FIG. 11A and FIG. 13A are examples of the dishing, wherein at central portions of the film 7 for the laminated interconnection board and of the insulating film 15 over broad areas are caved in due to too much polishing so as to result in a shortage of sectional areas for the laminated interconnection pattern 8 and the trench 16, to eventually become the defects.

FIG. 11B and FIG. 13B are examples of the erosion (thinning), wherein portions whose pattern density are high are caved in due to excessive polishing so as to result in a shortage of sectional areas for the laminated interconnection pattern 8 and the trench 16, to eventually become the defects.

FIG. 11C and FIG. 13C are examples of the recesses, wherein a side of the laminated interconnection pattern 8 and a side of the trench 16 are lowered at boundaries between the laminated interconnection pattern 8 and the insulating films 3 and between the trench 16 and the stopper film 13 so as to generate level differences, to consequently become defects.

FIG. 11D is an example of the scratch or the chemical damage, wherein an open circuit or short circuit or a failure in a resistance value of the laminated interconnection pattern 8 is generated, to eventually become faults.

FIG. 13D is an example such as the overpolishing and the underpolishing, wherein due to a shortage in relation to a set removal amount of the insulating films 15, the insulating films 15 remain on the surface of the board to consequently become defects, or due to an excessive amount in relation to the set removal amount of the insulating films 15 the sectional area of the trench 16 results in shortage to eventually become defects.

SUMMARY OF THE INVENTION

The present invention is planned and constituted according to the above-described circumstances, and it is an object of the present invention to provide a flattening polishing device and a flattening polishing method capable of conducting a flattening polishing with high accuracy and no defects.

In the present invention, and in the flattening polishing device for flatly polishing a surface of an object to be polished, the above-described object can be attained by providing the device with first polishing means and second polishing means which are coaxially disposed, moving means for moving the respective polishing means relative to each other in an axial direction and rotary means for rotating the respective polishing means around a shaft.

Further, in the present invention, and in the flattening polishing method for flatly polishing a surface of an object to be polished, the above-described object can be attained by providing the method with a process for rotating two polishing means disposed in shapes of concentric circles, a process for protruding a polishing surface of one of the polishing means more than a polishing surface of the other polishing means to a side of the object to be polished, a process for polishing the surface of the object to be polished by one of the polishing means, a process for protruding the polishing surface of the other polishing means more than the polishing surface of the one of the polishing means to the side of the object to be polished and a process for polishing the surface of the object to be polished by the other polishing means.

According to the above-described constitution, since the two polishing means are arranged coaxially, the device can be made in compact size without any need for installation of a plurality of large surface plates as in the related device. Further, since the object to be polished can be machined in multi-steps by one chuck, variations in machining accuracy due to rechucking can be suppressed. Furthermore, since fixed size and highly efficient machining or fixed pressure and highly graded chemical machining can be carried out in multi-steps, it is possible to machine the object to be polished with no defects.

Further, in the case of polishing process for compound semiconductor, two-step polishing is performed with liquid polishing agents changed. A series process for performing two-step polishing and a parallel process for performing one-step polishing in parallel can therefore be selectively carried out in one polishing device.

DETAILED DESCRIPTION OF THE PREFERRED EMBODIMENTS

Hereinafter, preferred embodiments of the present invention will be described in detail with reference to the accompanying drawings.

Meanwhile, since these embodiments are specific, favorable examples of the present invention, they include technically various preferable limitations, but they are not to be construed to limit the scope of the present invention, unless there are any particular mentions with respect to the limitation of the present invention in the following description.

Figure 1:
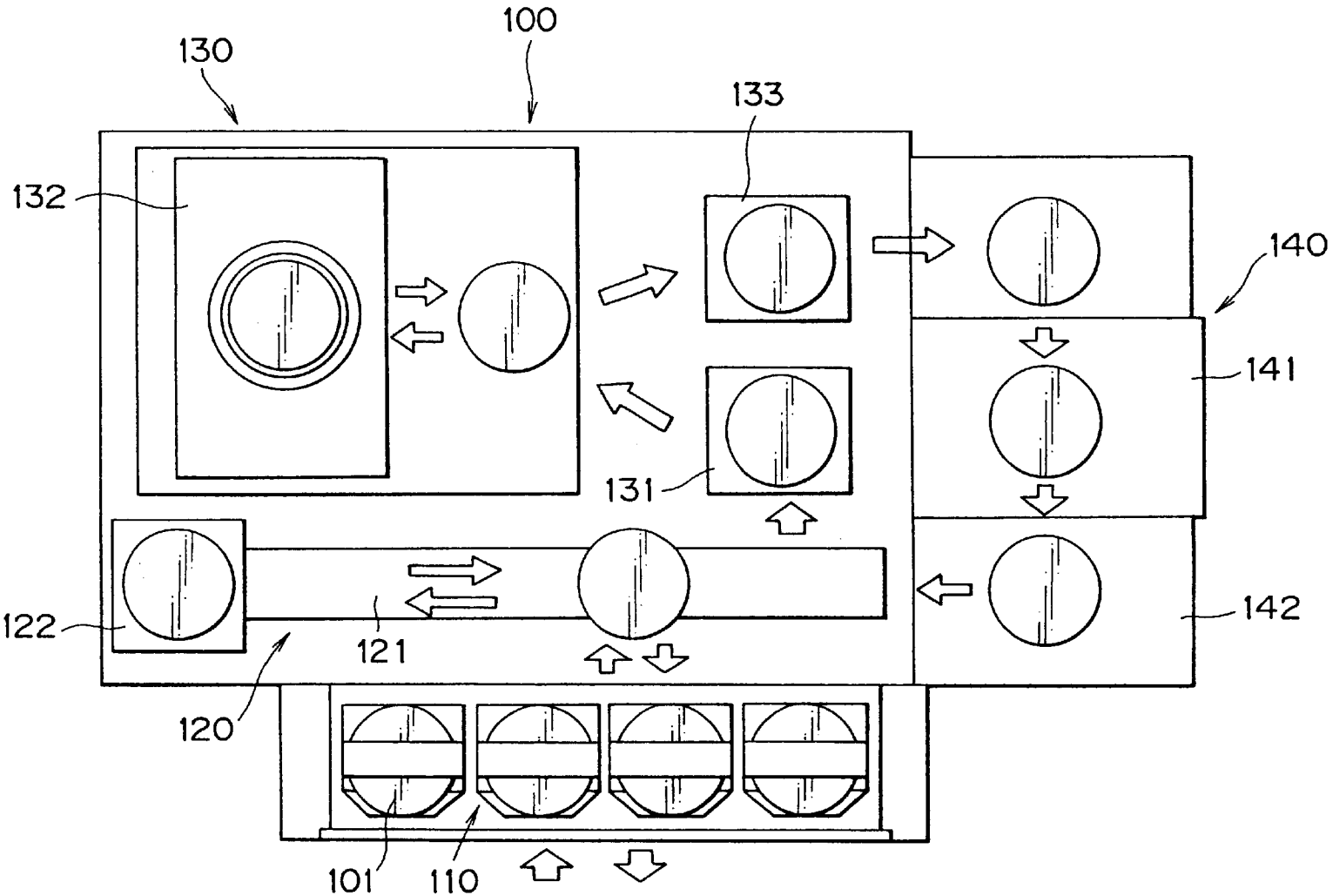
FIG. 1 shows a plan view illustrating the entire constitution of the embodiments for a flattening polishing device of the present invention.

FIG. 1 shows a plan view illustrating the entire constitution of the embodiment for a flattening polishing device of the present invention.

This flattening polishing device 100 is roughly constituted of; a cassette port 110 section into which wars 101, being objects to be polished, are loaded; a handling system 120 section for positioning the wafers 101 unloaded from the cassette port 110; a polishing head 130 section for conducting chemical mechanical polishing on the wafers 101 positioned by the handling system 120 and a cleaner 140 section for cleaning the wafers 101 which have been conducted with the chemical mechanical polishing by the polishing head 130. Further, the wafers 101 are carried among respective sections by a robot not shown.

In such constitution, a polishing process conducted within the flattening polishing device 100 will be described.

First, a plurality of wafers 101 are stored inside of cassette 102 in parallel, and the cassettes 102 are set in the cassette port 110. Further, a sheet of wafer 101 is unloaded from the cassette 102 and carried to the handling system 120.

The wafer 101 which has been carried is transferred to a positioning part 122 by a conveyer 121 and the centering and orientation and flattening alignment are performed, then again transferred back to an original position by the conveyer. The transferred-back wafer 101 is transported to the polishing head 130. The transported wafer 101 is loaded into a buffer 131 once, being set in a machining part 132 thereafter, and being subjected to the chemical mechanical polishing. The wafer 101, having been polished, is once unloaded in a wet station 133 and then transported to the cleaner 140.

The transported wafer 101 is, after passing through the cleaning part 141 for cleaning the wafer of a chemical, transferred to a drying part for drying a cleaning solution. The wafer 101 which has been dried is transported again to the handling system 120 and stored in a vacant portion of the cassette 102. The cassettes 102 whose entire stored wafers 101 are finished passing through the above-mentioned process are unloaded from the cassette port 110 and are transported to a next process.

Figure 2:
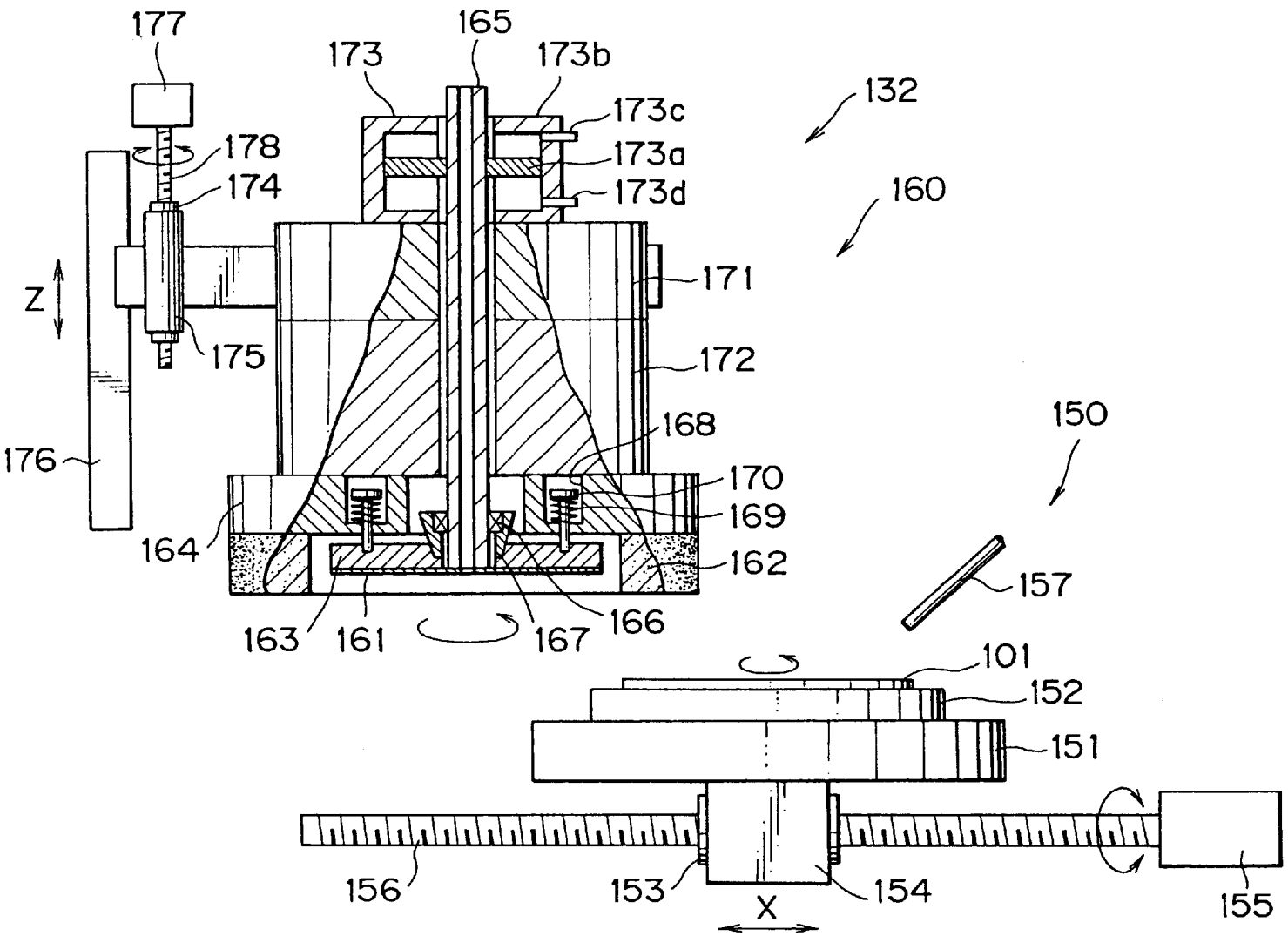
FIG. 2 shows a partial sectional side elevation view illustrating details of the machining parts in the flattening polishing device shown in FIG. 1.

FIG. 2 shows a partial sectional side elevation view illustrating details of the machining part 132 in the flattening polishing device 100 shown in FIG. 1.

The machining part is roughly constituted of a machining table 150 and a machining head 160.

The machining table 150 has functions to rotate the wafer 101 while placing and fixing it on the table as well as to move it along the X axis.

A wafer chuck 152 is disposed on the top face of a weighing table 151 capable of vacuum-adsorbing the wafer 101, and the support part 154 having an X-axis ball nut 153 is disposed in the bottom face of the weighing table 151.

An X-axis ball screw 156 which is connected with an X-axis servomotor 155 and extended along the X axis is threadedly engaged with the X-axis ball nut 153. Further, a nozzle 157 for supplying a polishing solution is disposed above the weighing table 151. Furthermore, a mechanism, not shown, for rotating the wafer chuck 152 is incorporated in the weighing table 151.

The machining head 160 has functions such that it moves along the Z axis and conducts the chemical mechanical polishing in two stages on the wafer 101 fixed on the machining table 150. A buff (first polishing means) 161 in a shape of a disk having substantially the same diameter as that of the wafer 101 and a wheel (second polishing means) 162 in a shape of an annular ring having a larger inside diameter than a diameter of the buff 161 are disposed coaxially, namely, in a shape of a concentric circle. Further, the buff 161 is bonded and fixed on the bottom face of a metal surface plate (the first polishing means) 163 in a shape of an annular ring, and the wheel 162 is bonded and fixed on the bottom face of a metal tool flange (the second polishing means) 164 in a shape of an annular ring.

One end of a shaft i.e., a (fixed shaft) 165 is fixed in a center hole of the metal surface plate 163 via a flange 167 having a bearing 166. An outer peripheral surface of this flange 167 is formed in a taper shape, and fitted and fixed into an inner peripheral surface of a hole bored in a central portion of the metal surface plate 163 which is formed in a similar taper shape as that of the flange 167. Counterbores 168 are arranged in an equal angular space on a side of a top face of the metal tool flange 164.

Pins 170 having springs 169 are inserted in the inner portions of the counterbores 168 in such a manner that each pin 170 is pierced through to a side of a bottom face of the metal tool flange 164. A tip end of each pin 170 is threadedly engaged with the top face of the metal surface plate 163. A main spindle (rotary means) 172 having a main spindle motor (rotary means) 171 is fixed on the top face of the metal tool flange 164, and further, an air cylinder (moving means) 173 is fixed above the main spindle motor 171.

The shaft 165 is disposed so as to be pierced through from a central hole of the metal tool flange 164 via central portions of the main spindle 172, the main spindle motor 171 and the air cylinder 173. Further, a piston 173*a* of the air cylinder 173 is fixed on the other end of the shaft 165.

Further, the shaft 165 is formed in a shape of a hollow cylinder in order to supply the polishing solution.

A supporting portion 175 having a Z-axis ball nut 174 is disposed on an outer peripheral surface of the main spindle motor 171. Further, the supporting portion 175 is engaged with a Z-axis guide 176 , and a Z-axis ball screw 178 which is connected with a Z-axis servomotor 177 and extends along the Z axis is threadedly engaged with the Z-axis ball nut 174.

Figure 3A:
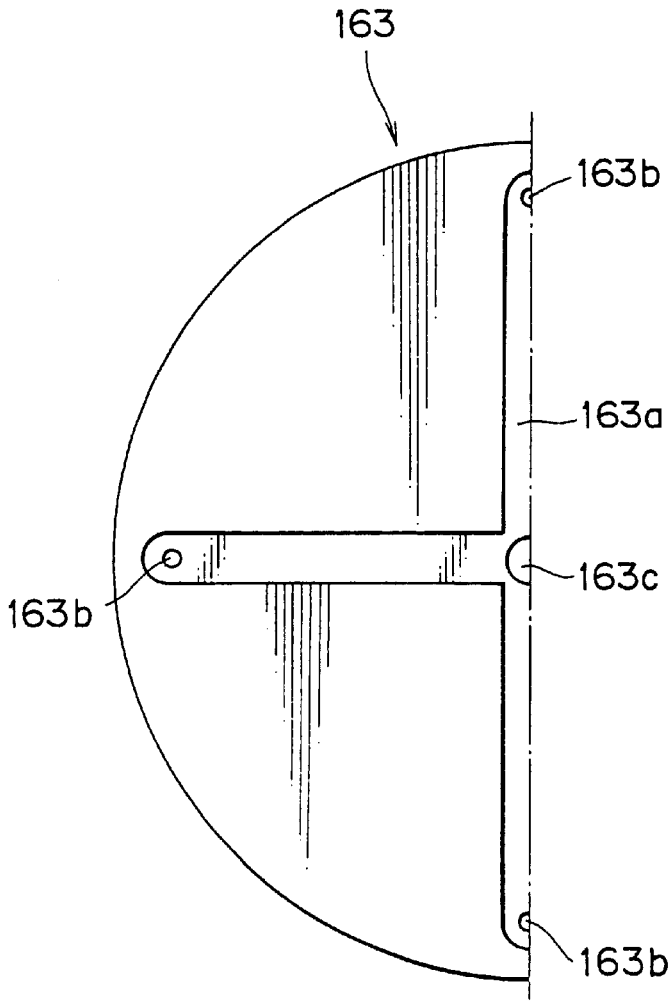
FIGS. 3A and 3B show a plan view and a sectional side elevation view illustrating a detailed example of a metal surface plate shown in FIG. 2.
Figure 3B:
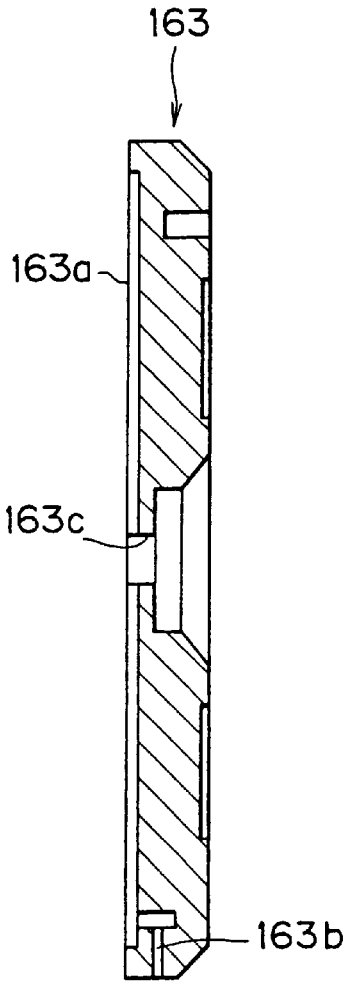

FIGS. 3A and 3B respectively show a plan view and a sectional side elevation view illustrating a detailed example of a metal surface plate 163 shown in FIG. 2.

A cruciform groove 163*a* is formed on the bottom face of the metal surface plate 163, namely on the surface where the buff 161 is bonded and fixed. Further, through holes 163*b* are provided at tip end parts of the cruciform groove 163*a* piercing through from a bottom portion of the groove 163*a* to a peripheral surface of the metal surface plate 163.

Figure 4A:
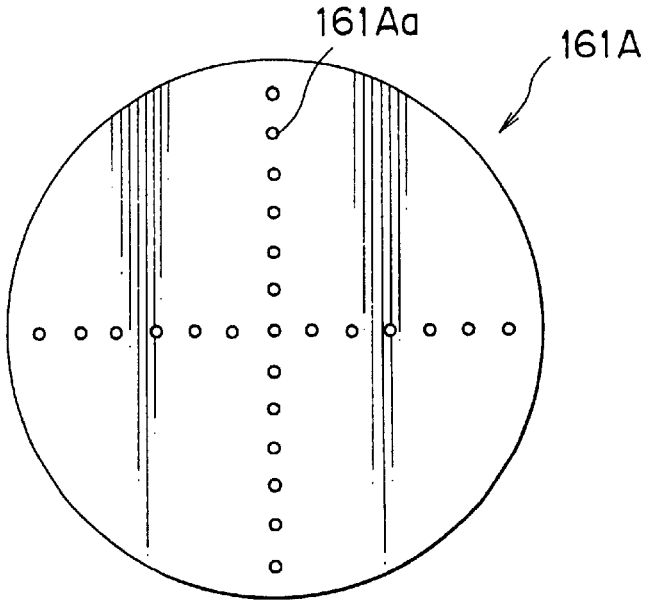
FIGS. 4A and 4B show plan views illustrating detailed example of buffs shown in FIG. 2.
Figure 4B:
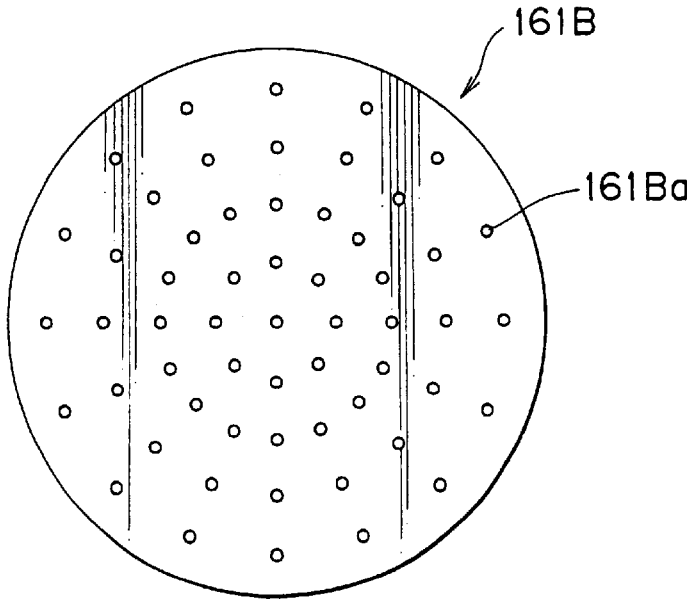

FIGS. 4A and 4B show plan views illustrating detailed examples of buffs 161 shown in FIG. 2.

A plurality of holes 161A*a* are arranged in a cruciform on a buff 161A shown in FIG. 4A in accordance with the groove 163*a* of the metal surface plate 163. Further, a plurality of holes 161B*a* are further arranged in a shape of radiation on a buff 161B shown in FIG. 4B. The buff 161A or 161B is bonded and fixed on the bottom face of the metal surface plate 163 having a constitution described above, namely on the surface formed with the groove 163*a*.

Accordingly, the polishing solution supplied from the hollow portion of the shaft 165 flows into the groove 163*a* after passing through a central hole 163*c* of the metal surface plate 163. Further, on the way the polishing solution flows into the groove 163*a*, a part of the polishing solution flows into a polishing surface of the buffs 161A or 161B after passing through the holes 161A*a* or 161B*a* of the buffs 161A and 161B and a residual part, in other words a surplus part of the polishing liquid is discharged from the outer peripheral surface of the buff 161A or 161B after passing through the through holes 163*b* of the metal surface plate 163. Accordingly, the polishing accuracy and polishing efficiency can be improved since the polishing liquid is evenly spread over the entire polishing surface of the buff 161A or 161B.

Figure 5:
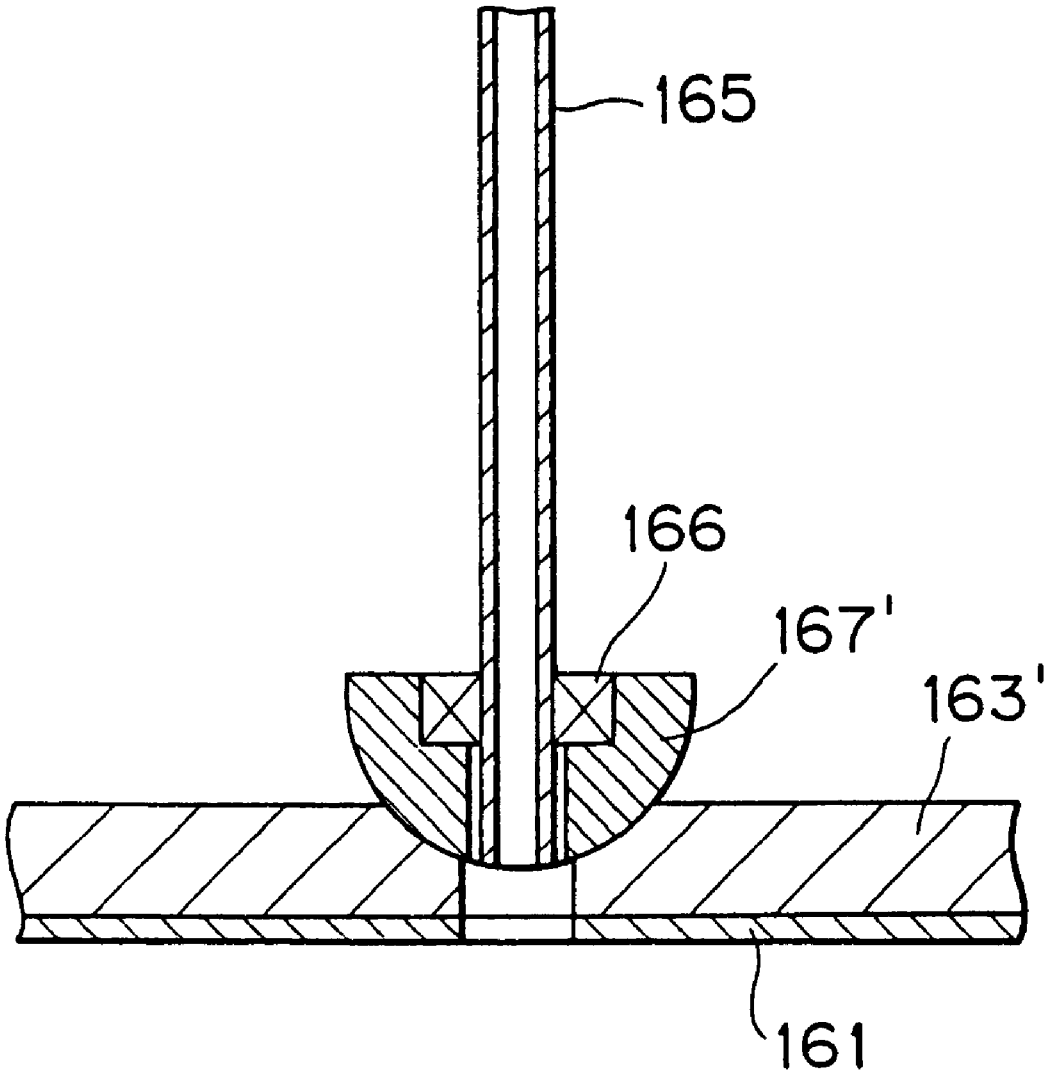
FIG. 5 shows a sectional side elevation view illustrating another example of a flange which connects the metal surface plate and a shaft in the flattening polishing device shown in FIG. 1.

FIG. 5 shows a sectional side elevation view illustrating another example of a flange which connects a metal surface plate with the shaft. An outer peripheral surface of this flange 167' is formed in a semi-spherical shape, and is closely adhered in a slidable manner on an inner peripheral surface in a hole of a central portion of a metal surface plate 163' formed in a similar semi-spherical shape.

According to the constitution, in cases where, for example, a surface of the wafer 101 is inclined, when the polishing surface of the buff 161 is in contact with the surface of the wafer 101, since the metal surface plate 163' is pivoted around the flange 167', the polishing surface of the buff 161 always can horizontally be in contact with the surface of the wafer 101. Therefore, the flatness of the surface of the wafer 101 can be made up of high preciseness.

Figure 6:
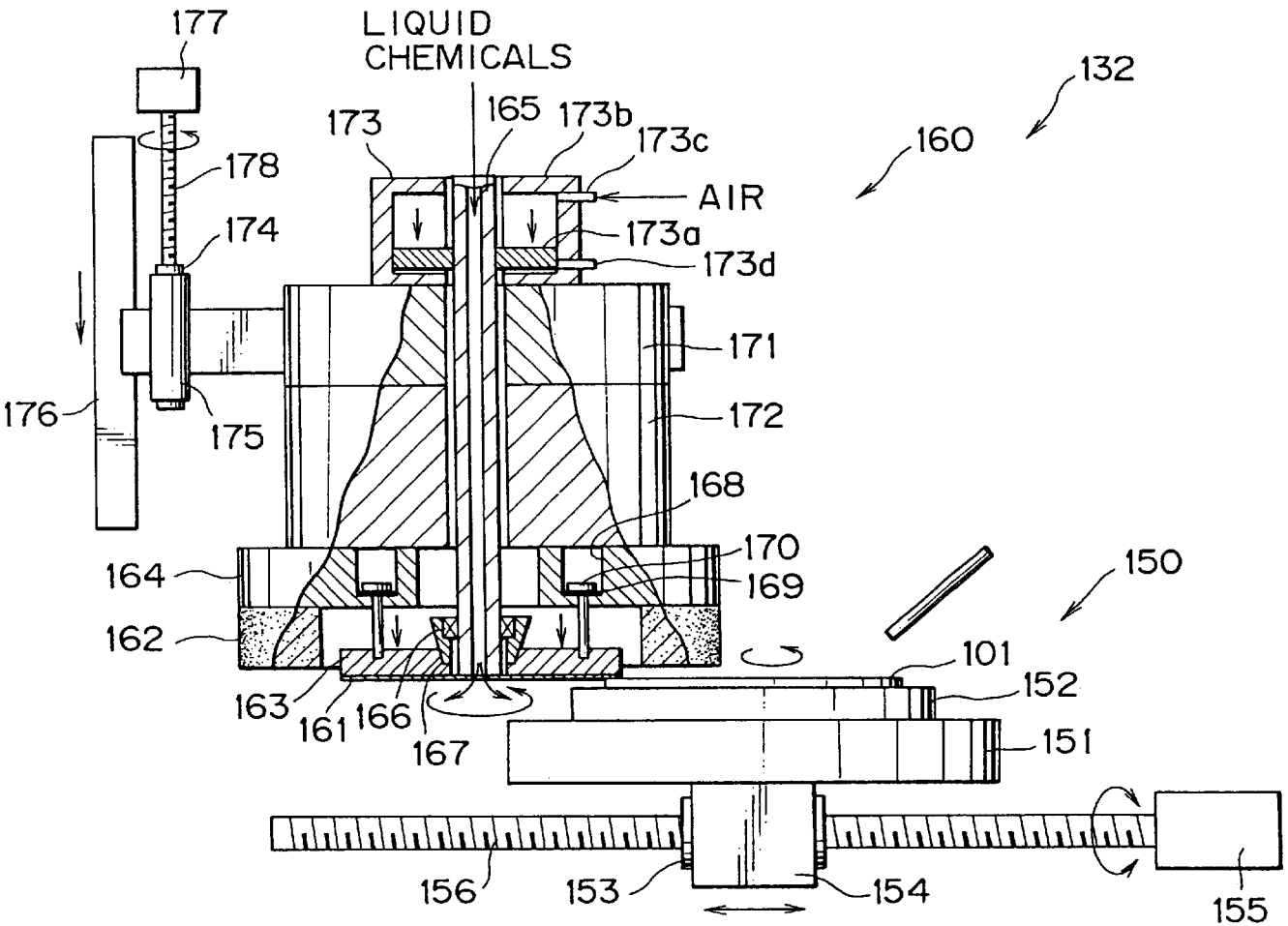
FIG. 6 shows a first sectional side elevation view illustrating an example of operation in the flattening polishing device shown in FIG. 1.

In the above-mentioned constitutions, operational examples of them will be described with reference to FIG. 6 and FIG. 7.

Here, as a material of the buff 161, a soft quality buff, for example, is used and as a polishing solution, a liquid chemical of, for example, etchant of a nitric acid ($HNO_3$) or the like is used. Further, as the wheel 162, for example, a hard quality wheel in which hard alumina abrasive grains are solidified is used and as its polishing solution, for example, slurry in which hard alumina abrasive grains are dispersed by weak acid is used.

Figure 7:
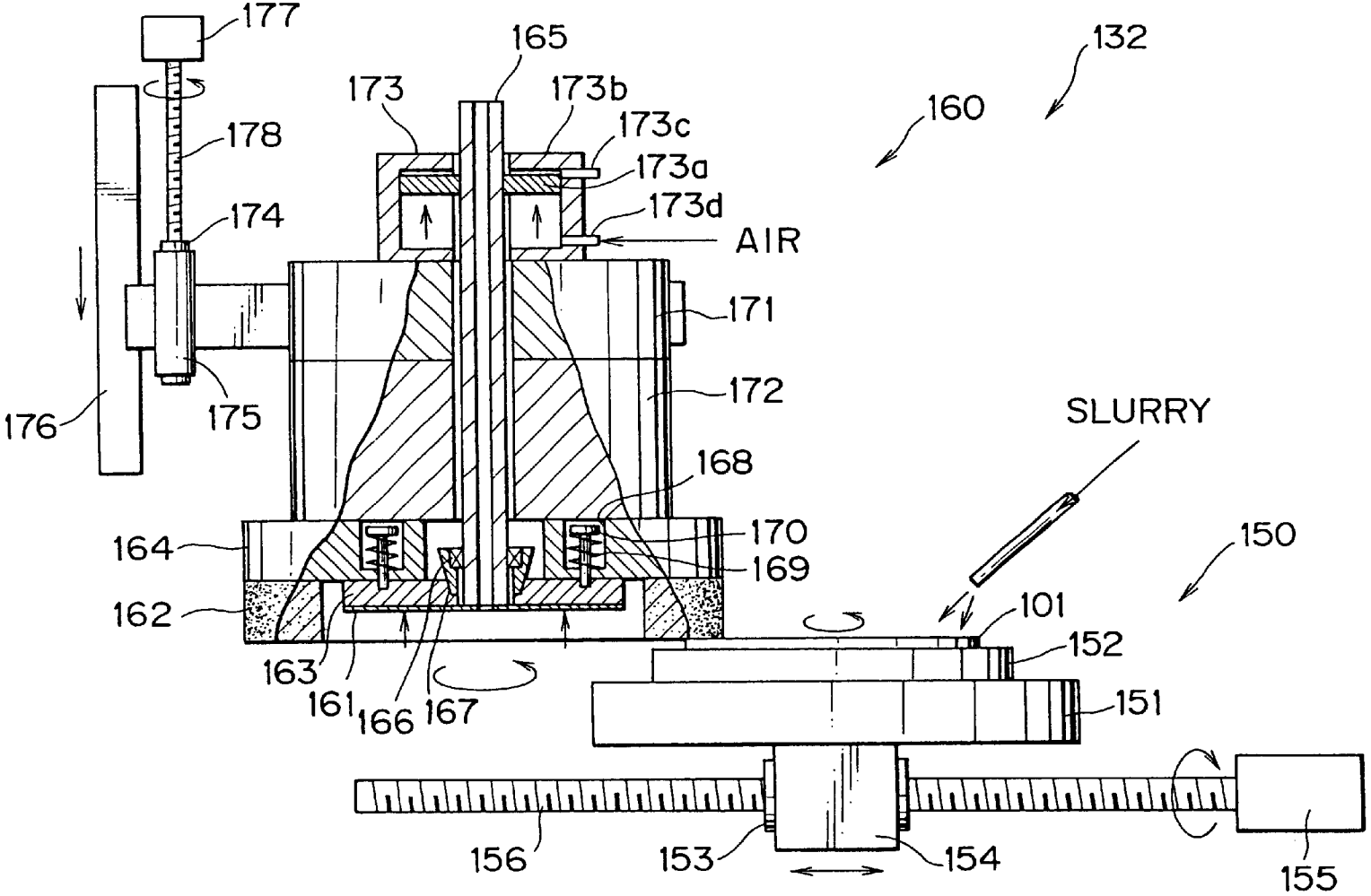
FIG. 7 shows a second sectional side elevation view illustrating another example of operation in the flattening polishing device shown in FIG. 1.

As a first stage, polishing with the usage of the buff 161 is performed (refer to FIG. 6) and as a second stage, polishing using the wheel 162 is performed (refer to FIG. 7).

First, the wafer 101 is vacuum-adsorbed to the wafer chuck 152, then the X-axis ball screw 156 is rotated by driving the X-axis servomotor 155, and then the weighing table 151 is moved until the wafer 101 arrives at a prescribed polishing start position via the support part 154. Further, the rotary mechanism incorporated in the weighing table 151 is driven so as to rotate the wafer 101 via the wafer chuck 152. Simultaneously, the main spindle motor 171 is driven so as to rotate the wheel 162 via the main spindle 172, further to rotate the buff 161 via the pins 170.

Next, the Z-axis servomotor 177 is driven so as to rotate the Z-axis ball screw 178, then the supporting portion 175 is lowered until it becomes in such a condition that the polishing surface of the wheel 162 is separated with a prescribed space from the surface of the vacuum-adsorbed wafer 101 along the Z-axis guide 176. Further, liquid chemical is supplied from a supply device, not shown, to the buff 161 via the hollow portion of the shaft 165 and the groove 163*a* of the metal surface plate 163. Simultaneously, air is supplied to a pressurized side supply port 173*c* provided in a cylinder 173*b* of the air cylinder 173 and the metal surface plate 163 is lowered via the piston 173*a* and the shaft 165.

At this time, it becomes in such a condition that the metal surface plate 163 gives compression to the spring 169 and the polishing surface of the buff 161 is more protruded than the polishing surface of the wheel 162. Further, the polishing surface of the buff 161 is forcedly pressed on the surface of the wafer 101, the X-axis servomotor 155 is driven so as to rotate the X-axis ball screw, the weighing table 151 is reciprocatingly moved via the support part 154 and the chemical mechanical polishing is conducted on the wafer 101. Furthermore, an absolute value of a polishing amount can be controlled mainly by a pressure within the air cylinder 173 and by a passing speed of the buff 161 in relation to the wafer 101. Further, after finishing the polishing, the supply of the liquid chemical is stopped, pure water is supplied on the surface of the wafer 101 through a not-illustrated nozzle and the liquid chemical remained on the surface of the wafer 101 is cleaned to be removed.

As described above, on the reason that the soft quality buff is used and that etching is performed using the acid, in the polishing process of this first stage, a selective ratio, that is for example, a ratio of polishing rates between a film 7 for a laminated interconnection pattern and a barrier film 5 in cases where the wafer 101 is a metal interconnection type board or a ratio of polishing rates between an insulating film 15 and a stopper film 13 in cases where the wafer 101 is a element separation type board becomes large and the stopping accuracy at the barrier film 5 and the stopper film 13 is enhanced.

Accordingly, dishing and erosion become large and a polishing and removing speed becomes slow; however, absolute values of the dishing and the the erosion can be made small and polishing process time can be shortened by setting small an absolute value of a total polishing and removing amount at the first stage. Further, since the polishing process is the strong machining in a chemical reaction with the usage of the buff 161, the surface of the wafer 101 is hardly damaged so as to have a mechanically smooth face.

Succeedingly, air is supplied to a refuge side supplying port 173*d* provided in the cylinder 173*b* of the air cylinder 173 and the metal surface plate 163 is lifted via the piston 173*a* and the shaft 165 so as to separate the polishing surface of the buff 161 from the surface of the wafer 101. At this time, the top face of the metal surface plate 163 is forcedly pressed against the bottom face of the metal tool flange 164 by a restoring force of the springs 169, the polishing surface of the buff 161 becomes more retracted than the polishing surface of the wheel 162.

Further, the slurry is supplied from a supply device, not shown, to the surface of the wafer 101 via the nozzle 157. Simultaneously, the Z-axis servomotor 177 is driven in the direction opposite to the prior case so as to rotate the Z-axis ball screw 178 and to lower the supporting portion 175 along the Z-axis guide 176. Further, the polishing surface of the wheel 62 is forcedly pressed against the surface of the wafer 101 so as to rotate the shaft ball screw 156 by driving the X-axis servomotor 155 and to conduct the chemical mechanical polishing on the wafer 101 by reciprocatingly moving the weighing table 151 via the support part 154. Furthermore, the absolute value of the polishing amount at this time, can be controlled mainly by a thrust amount with the aid of the Z-axis servomotor 177 and by a passing speed of the wheel 162 in relation to the wafer 101. Further, after finishing the polishing, the supply of the slurry is stopped so as to supply the pure water and the liquid chemical on the surface of the wafer 101 through the not-illustrated nozzle, to clean and remove the slurry and particles remaining on the surface of the wafer 101.

As described above, a reason that the hard quality wheel is used, and that since the slurry is a weak acid, the above mentioned selection ratio is small, in the polishing process of this second stage, the polishing of the portion of the film 7 for the laminated interconnection pattern and of the portion where the barrier films 5 start to be exposed can be uniformly progressed in cases where, for example, the wafer 101 is the metal interconnection type board, and the polishing of the portion of the insulating films 15 and of the portion where the stopper films 13 start to be exposed can also be uniformly progressed in cases where the wafer 101 is the element separation type board. Therefore, the dishing and the erosion is small compared with the cases where the related pad and slurry are used, and highly efficient polishing with comparatively high polishing and removing speed can be made possible.

Furthermore, in the above-mentioned embodiments of the flattening polishing method, rough polishing by means of the buff 161 is conducted at the first stage and finish polishing by means of the wheel 162 is conducted at the second stage. However rough polishing by means of the wheel 162 may be conducted at the first stage and finish polishing by means of the buff 161 may be conducted at the second stage. In that case, since dimensional accuracy and stoppage accuracy is insufficient because of smallness in the selection ratio, and moreover since micro roughness and damage remain on the surface of the wafer 101 because of high efficient polishing by means of the hard quality wheel, the polishing by means of the wheel 162 is to be finished in a rough range. The polishing is in a condition that the film 7 for the laminating interconnection pattern slightly remains on the barrier film 5 in cases, for example, where the wafer 101 is the metal interconnection type board, or in a condition that the insulating films 15 slightly remain on the stopper films 13 in cases where the wafer 101 is the element separation type board.

Further, the dimensional accuracy is enhanced with the polishing by means of the buff 161 so as to remove remaining damaged layers.

Furthermore, the polishing by means of the buff 161 and the polishing by means of the wheel 162 may concurrently be conducted. According to this method, the rough and finish polishing can be conducted in one operation, and a polishing man-hour can remarkably be reduced.

FIG. 8 and FIG. 9 illustrate dishing evaluation and erosion evaluation by a surface profile observation when conducting the polishing of the present embodiment and a related polishing. Furthermore, related polishing conditions have been that while a pad (a polyurethane foam pad IC-1000 (a product of Rodel, Inc. in the United States) is rotated at a rotational speed of 30 rpm to 60 rpm, the pad is forcedly pressed with a pressure of 150 kgf/cm$^2$ to 250 kgf/cm$^2$ and that a prescribed kind of slurry (an alumina slurry C4010 (a product of Cabot Corporation in U.S.)) is supplied.

Figure 8A:
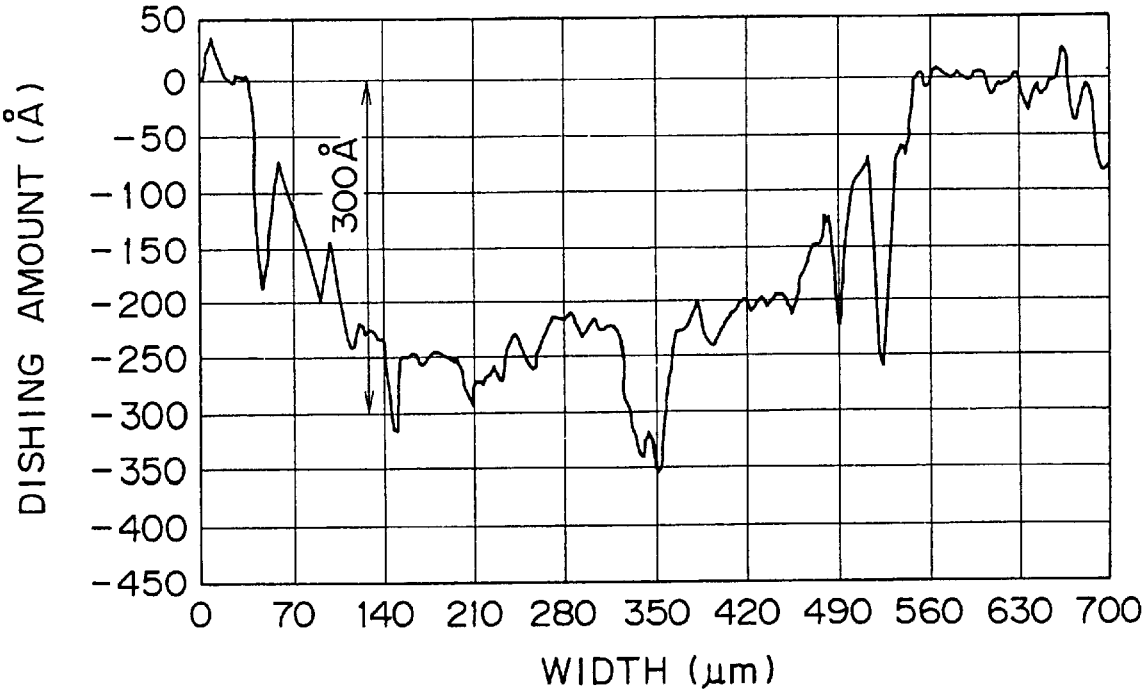
FIGS. 8A and 8B show graphs illustrating dishing evaluation with regard to the flattening polishing device shown in FIG. 1 and a related polishing device.
Figure 8B:
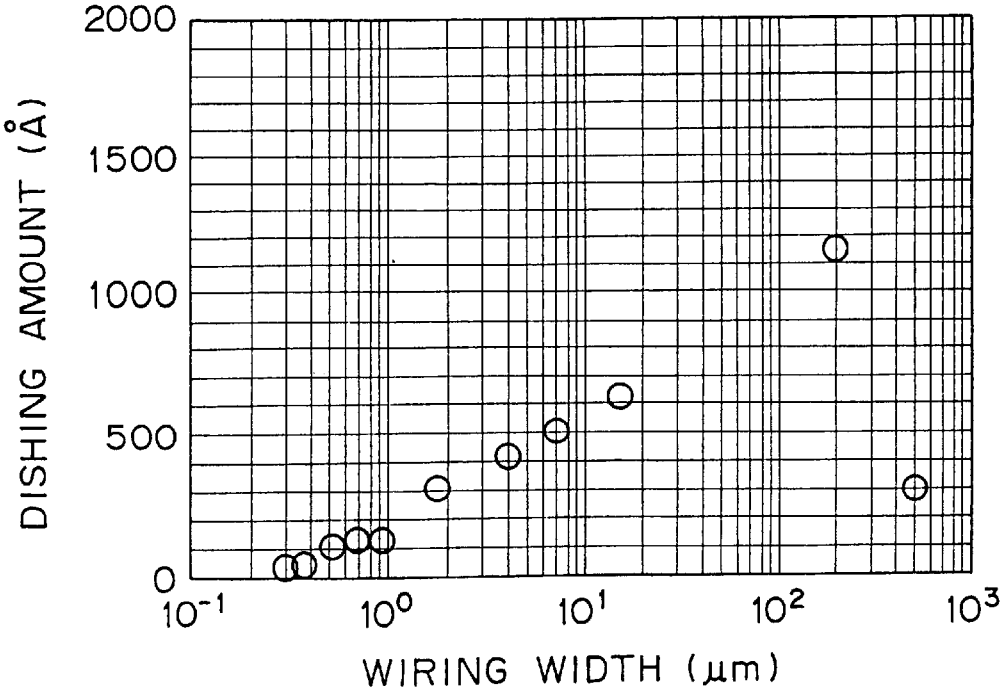

FIG. 8A illustrates the dishing condition of an interconnection pattern having a width 500 $\mu$m by the polishing of the present embodiment, and a dishing amount has been about 300 Å. FIG. 8B illustrates a relationship between an interconnection width and the dishing amount, points indicated by white circle marks show data obtained by the related polishing and points indicated by black painted round marks show data illustrated in FIG. 8A. According to the polishing in the present embodiments, as will be clear from these figures, the dishing can more remarkably be improved than the related polishing.

Figures 9A, 9B:
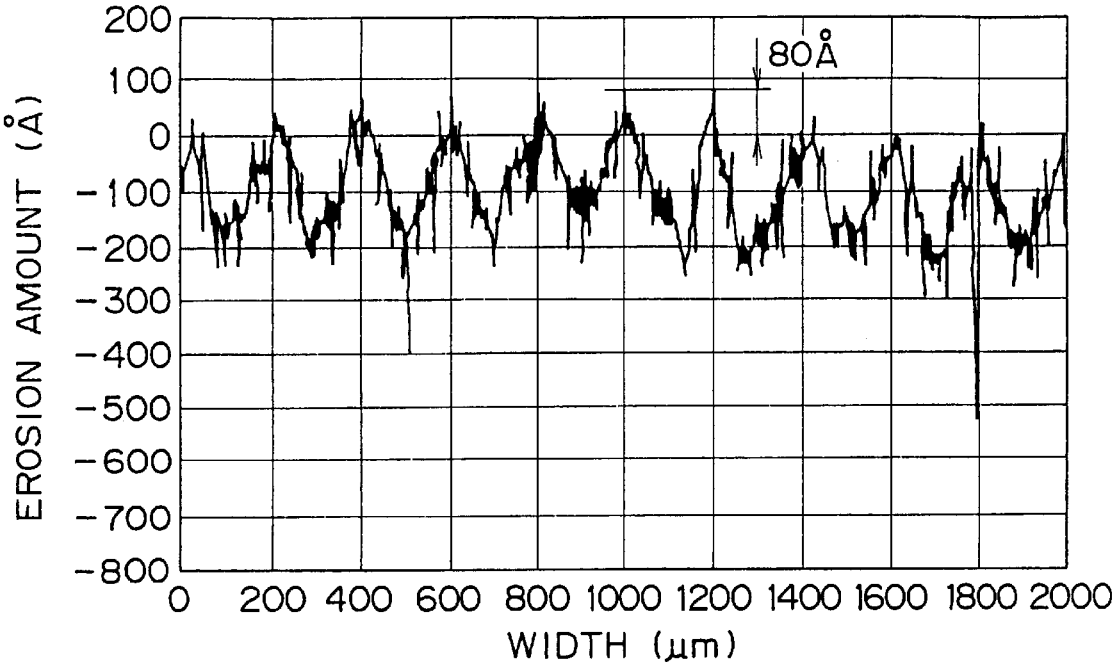
FIGS. 9A and 9B shows graphs illustrating erosion evaluation with regard to the flattening polishing device shown in FIG. 1 and a related polishing device.
Figure 10A:
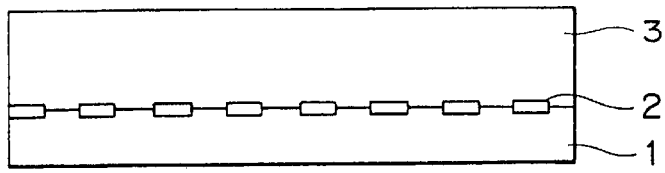
FIGS. 10A to 10F show sectional side elevation views illustrating manufacturing processes for a metal interconnection type board.
Figure 10B:
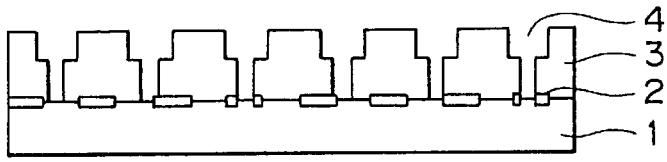
Figure 10C:
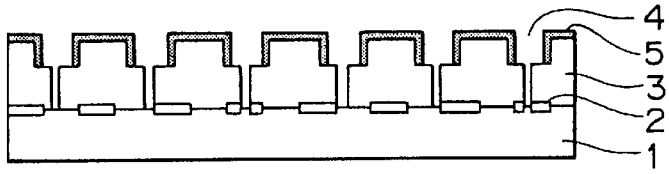
Figure 10D:
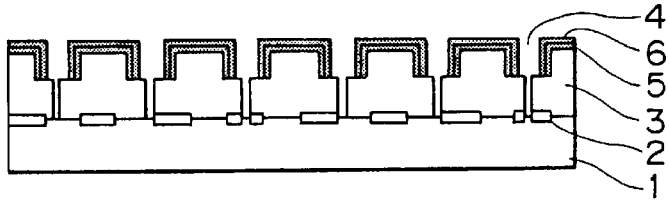
Figure 10E:
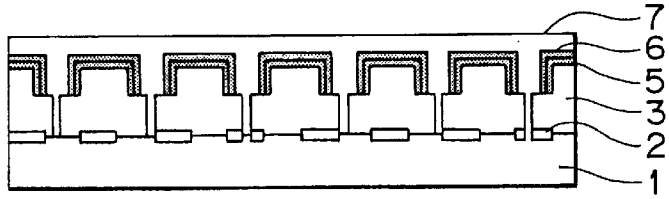
Figure 10F:
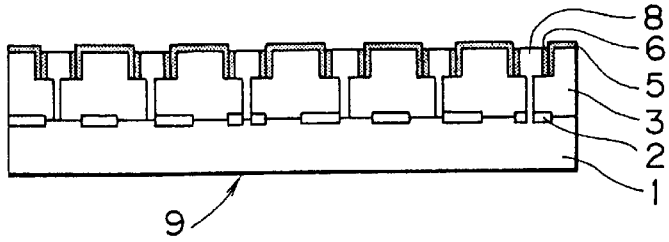
Figure 11A:
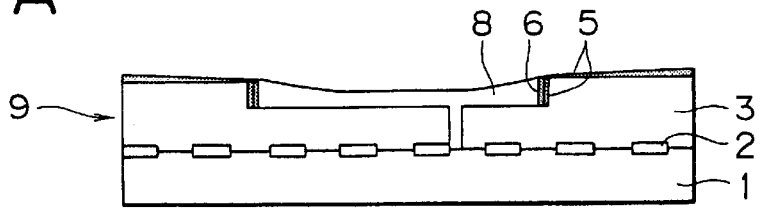
FIGS. 11A to 11D show sectional side elevation views illustrating defects in the metal interconnection type board.
Figure 11B:
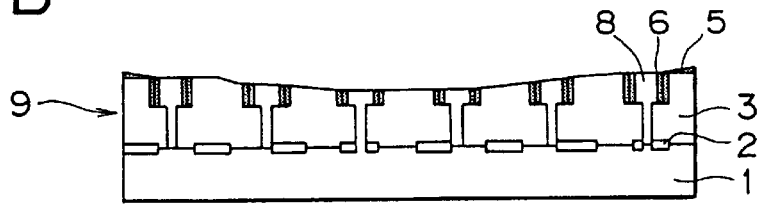
Figure 11C:
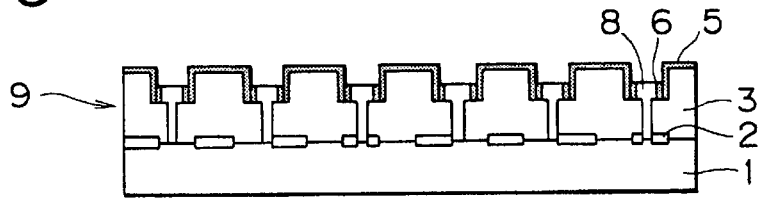
Figure 11D:
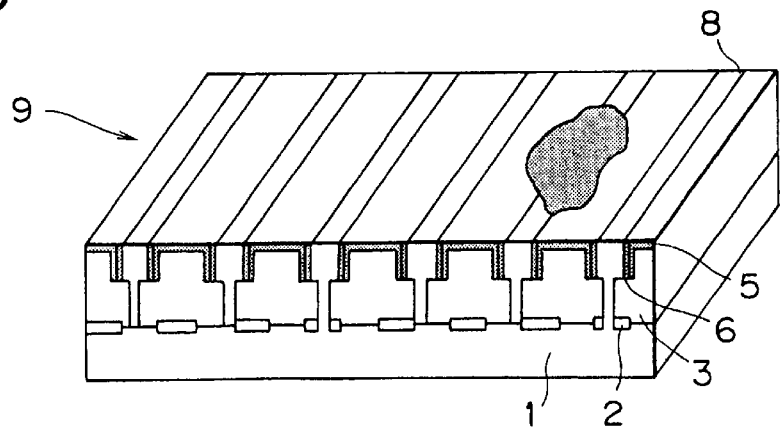
Figure 12A:
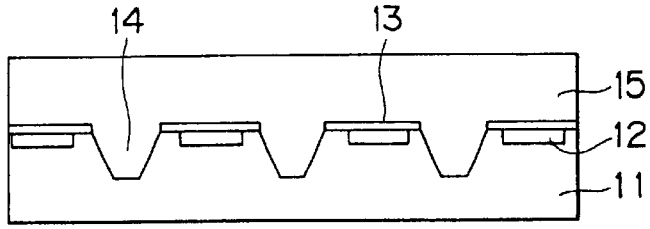
FIGS. 12A and 12B show sectional side elevation views illustrating manufacturing processes for an element separation type board.
Figure 12B:
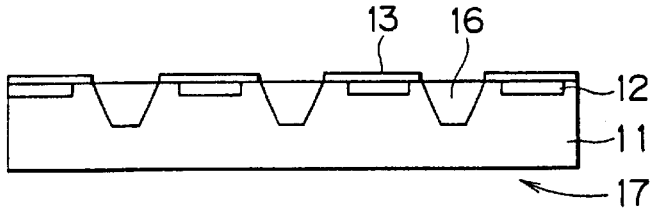
Figure 13A:
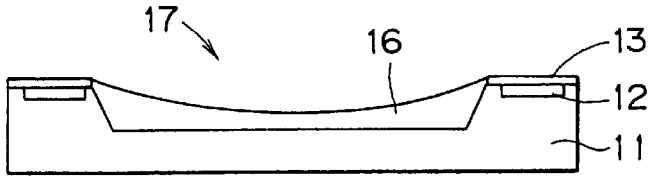
FIGS. 13A to 13D show sectional side elevation views illustrating defects in the element separation type board.
Figure 13B:
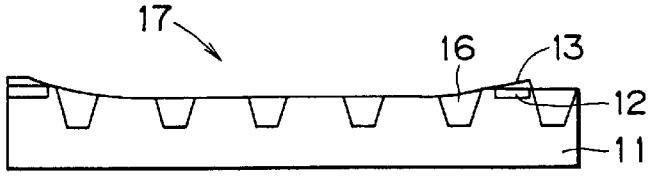
Figure 13C:
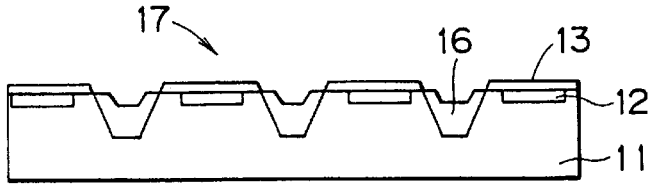
Figure 13D:
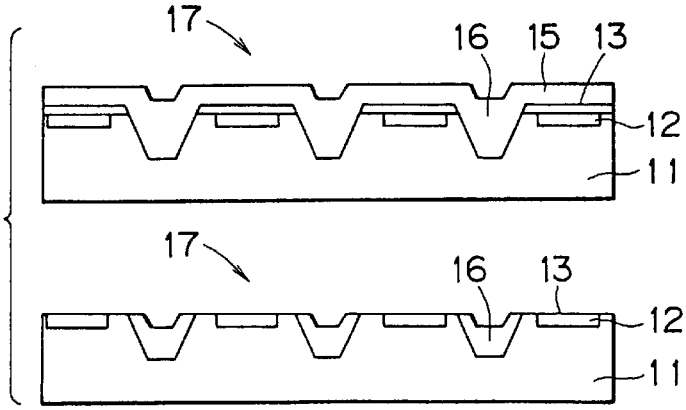
Figure 14:
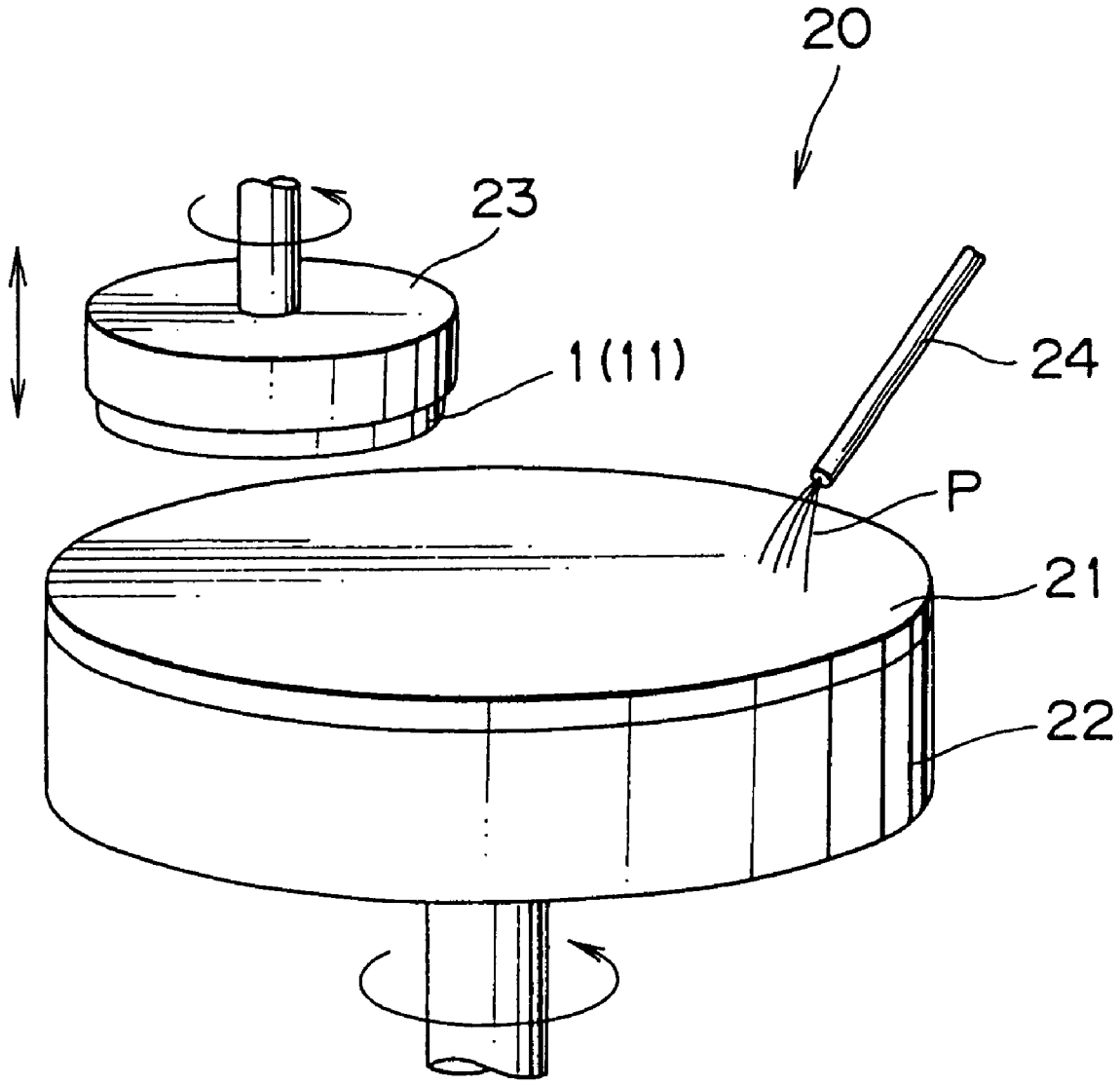
FIG. 14 shows a perspective view illustrating an outline of a related flattening polishing device.

FIG. 9A illustrates an erosion condition of parts where an interconnection density is 50%, a line and space is 100 $\mu$m by the polishing of the present embodiment, the erosion amount has been about a maximum of 80 Å. FIG. 9B illustrates the relationship of area dependency of the erosion, though there are no data corresponding to FIG. 11A, according to the polishing of the present embodiments, as will be clear from a comparison that the erosion amount is 75 nm (750 Å) at the amount 2.00 $\mu$m and that the erosion is 30 nm (300 Å) at the amount 0.25 $\mu$m, the erosion can more remarkably be improved than the related polishing.

As mentioned above, according to the present invention, the highly accurate and non-defective flattening polishing can be conducted.

What is claimed is:

1. A flattening polishing device adapted to flatly polish a surface of an object to be polished, comprising:

first polishing means and second polishing means both having polishing surfaces and being coaxially disposed around a shaft, said first polishing means being disposed at an end of said shaft via a flange incorporating a bearing;

moving means for moving said first polishing means, together with said shaft, relative to each of the polishing surfaces of said respective polishing means in an axial direction;

rotary means for rotating said respective polishing means around said shaft; and a rotary table for disposing and rotating an object to be polished by said first and second polishing means.

2. A flattening polishing device as claimed in claim 1, wherein said shaft is formed in a shape of a hollow cylinder in order to supply a polishing solution through said cylinder.

3. A flattening polishing device as claimed in claim 1, wherein said respective polishing means are disposed in shapes of concentric circles.

4. A flattening polishing device adapted to flatly polish a surface of an object to be polished, comprising:

a fixed shaft formed in a shape of a hollow cylinder in order to supply a polishing solution through said hollow cylinder;

first polishing means having a shape of a disk disposed at one end of said fixed shaft and rotatable around the shaft;

second polishing means in a shape of an annulus ring engaged with said first polishing means, arranged on an outer periphery of said first polishing means and rotatable around the shaft;

moving means disposed on the outer end of said fixed shaft, moving said first polishing means together with said fixed shaft relative to each of the polishing surfaces of said respective polishing means;

rotary means for rotating said respective polishing means around the shaft; and a rotary table for disposing and rotating an object to be polished by said respective polishing means.

5. A flattening polishing device as claimed in claim 4, wherein said first polishing means is disposed at the one end of said fixed shaft via a flange having a bearing.

6. A flattening polishing device as claimed in claim 5, wherein a surface of said flange in contact with said first polishing means is formed in a taper shape.

7. A flattening polishing device as claimed in claim 5, wherein a surface of said flange in contact with said first polishing means is formed in a spherical shape.

8. A flattening polishing method adapted to flatly polish a surface of an object to be polished, comprising the steps of:

rotating two polishing means, disposed in shapes of concentric circles, around a coaxial shaft, said first polishing means being disposed at an end of said shaft via a flange incorporating a bearing;

moving said shaft together with one of said polishing means so that a polishing surface of said one of said polishing means protrudes more than a polishing surface of the other of said polishing means;

polishing a surface of said object to be polished by said one of said polishing means while rotating said object to be polished on a rotating table;

protruding the polishing surface of the other polishing means more than the polishing surface of the one polishing means; and polishing a surface of said object to be polished by the other polishing means while rotating said object to be polished on a rotating table.

9. A flattening polishing method as claimed in claim 8, wherein a polishing solution is injected into a hollow portion of a central shaft to thereby supply the solution to the polishing surface when polishing the surface with said polishing means disposed inside.

10. A flattening polishing method adapted to flatly polish a surface of an object to be polished, comprising the steps of:

rotating two polishing means disposed in shapes of concentric circles around a fixed shaft, said first polishing means having a shape of a disk disposed at one end of said fixed shaft and rotatable around the shaft, and said second polishing means being in a shape of an annulus ring engaged with said first polishing means, arranged on an outer periphery of said first polishing means and rotatable around the shaft; and concurrently polishing the surface of said object to be polished by said respective polishing means while rotating said object to be polished on a rotating table.

11. A flattening polishing method as claimed in claim 10, wherein a polishing solution injected into a hollow portion of a central shaft so as to supply the solution to a polishing surface when polishing the surface with said respective polishing means.

* * * * *